US006591555B2

(12) United States Patent
King et al.

(10) Patent No.: US 6,591,555 B2
(45) Date of Patent: Jul. 15, 2003

(54) STORAGE UNIT HAVING FLEXIBLE COVER

(75) Inventors: Jonathan J. King, East Grand Rapids, MI (US); Joel T. Ruiter, Grand Haven, MI (US); David J. Dekkar, Holland, MI (US); James D. Houda, Grand Rapids, MI (US); Peter E. Mack, Holland, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/882,146

(22) Filed: Jun. 15, 2001

(65) Prior Publication Data

US 2002/0189179 A1 Dec. 19, 2002

(51) Int. Cl.[7] ..... E04B 2/74

(52) U.S. Cl. ..... 52/36.5; 52/239; 52/DIG. 4; 312/246; 312/297; 292/251.5

(58) Field of Search ..... 52/36.1, 36.4, 52/36.5, 36.6, 239, DIG. 4; 312/297, 245, 246; 160/330, 349.1; 211/90.01, 87.01; 292/251.5

(56) References Cited

U.S. PATENT DOCUMENTS

| | | | | |
|---|---|---|---|---|
| 141,561 A | | 8/1873 | Jensen | |
| 260,776 A | | 7/1882 | Otterson | |
| 344,212 A | | 6/1886 | Stephens | |
| 889,175 A | | 5/1908 | Bryant | |
| 933,570 A | | 9/1909 | Ludeman | |
| 1,062,277 A | | 5/1913 | Guricke | |
| 1,220,405 A | | 3/1917 | Feitshans | |
| 1,295,830 A | | 2/1919 | Lichtenstein | |
| 1,421,357 A | | 7/1922 | Allwork | |
| 1,816,411 A | | 7/1931 | Tillinger | |
| 1,902,313 A | | 3/1933 | Struble | |
| 2,094,940 A | | 10/1937 | Burdo | |
| 2,125,523 A | | 8/1938 | Smith | |
| 2,168,022 A | * | 8/1939 | Drager | 160/231.2 |
| D117,837 S | | 11/1939 | Tuttle | |
| 2,609,221 A | * | 9/1952 | Schultz | 292/251.5 |
| 2,722,469 A | * | 11/1955 | Kosovsky | 312/297 |

(List continued on next page.)

FOREIGN PATENT DOCUMENTS

| | | | | |
|---|---|---|---|---|
| AU | 206592 | * | 2/1957 | 312/297 |
| DE | 2758836 A | * | 7/1979 | 52/36.5 |
| FR | 612865 | * | 11/1926 | 312/297 |
| GB | 17452 | | 10/1891 | |

*Primary Examiner*—Carl D. Friedman
*Assistant Examiner*—Brian E. Glessner
(74) *Attorney, Agent, or Firm*—Price, Heneveld, Cooper & DeWitt & Litton

(57) ABSTRACT

A storage unit for use in an office environment. The storage unit includes a structural frame having two opposing side panels, at least one laterally extending panel extending between and interconnecting the side panels to define an interior space. The frame includes a perimeter defining an access opening that provides access to the interior space. The storage unit includes a flexible cover having opposing side edges, a front edge, and a rear edge. The flexible cover is attached to the structural frame proximate said rear edge of said flexible cover. The flexible cover extends freely from the attachment to the frame. The flexible cover has an engagement feature which is selectively engageable with the frame at first and second locations on the frame. Engagement of the cover with the frame at the first location places the flexible cover in a closed position with the opposing side edges of the flexible cover extending proximate the perimeter defining the access opening. Engagement of the flexible cover with the frame at the second location places the flexible cover in an open position wherein the flexible cover is positioned to allow access to the interior space of the storage unit through the access opening.

41 Claims, 4 Drawing Sheets

U.S. PATENT DOCUMENTS 3,116,097 A 12/1963 Novales
3,186,185 A 6/1965 Bently et al.
3,241,899 A 3/1966 Donker
3,317,259 A 5/1967 Otis
3,386,609 A 6/1968 Eurey
3,484,573 A 12/1969 Tingley
3,647,165 A * 3/1972 Whitla ..... 244/118.5
3,687,328 A 8/1972 Spruyt et al.
3,771,847 A 11/1973 Aylworth
3,899,228 A 8/1975 Schreiber
3,936,113 A * 2/1976 Anderson ..... 312/231
4,018,019 A * 4/1977 Raith et al. ..... 248/243
4,140,356 A * 2/1979 Chervanak ..... 312/111
4,270,816 A 6/1981 Erickson et al.
4,289,362 A * 9/1981 Kramer ..... 160/213
4,313,485 A 2/1982 Gidge et al.
4,365,855 A 12/1982 Mark
4,404,776 A * 9/1983 Ball et al. ..... 108/152
4,413,489 A 11/1983 Hogue
4,419,982 A 12/1983 Eckels
4,441,768 A 4/1984 Clarkson
4,801,180 A 1/1989 Styles
4,836,265 A 6/1989 Bussert
4,923,258 A 5/1990 Styles
4,986,329 A 1/1991 Kupchunos
5,010,944 A 4/1991 Bussert
5,025,848 A 6/1991 Prochaska
5,074,022 A 12/1991 Bussert
5,242,070 A 9/1993 Bretschneider et al.
D339,934 S 10/1993 Reuter
5,348,385 A 9/1994 Berg
5,405,114 A * 4/1995 Dias ..... 108/108
D372,811 S 8/1996 Muller-Deisig et al.
5,845,980 A 12/1998 Fricano et al.
5,850,864 A 12/1998 Decker
5,893,616 A * 4/1999 MacDonald et al. ..... 312/245
5,918,432 A * 7/1999 Mahone et al. ..... 52/220.2
6,076,308 A * 6/2000 Lyon et al. ..... 52/239
6,102,503 A * 8/2000 Hwang ..... 312/297
6,378,255 B1 * 4/2002 Eich et al. ..... 40/605

* cited by examiner

STORAGE UNIT HAVING FLEXIBLE COVER

BACKGROUND OF THE INVENTION

Modern offices commonly include a plurality of partitions dividing the office space into individual workspaces. Open office plans have been developed to reduce overall officing costs, and generally incorporate large, open floor spaces in buildings that are equipped with modular furniture systems which are readily reconfigurable to accommodate the ever-changing needs of a specific user, as well as the divergent requirements of different tenants. One arrangement commonly used for furnishing open plans includes movable partition panels that are detachably interconnected to partition off the open spaces into individual workstations and/or offices. Such partition panels are configured to receive hang-on furniture units, such as worksurfaces, overhead cabinets, shelves, etc., and are generally known in the office furniture industry as "systems furniture". Another arrangement for dividing and/or partitioning open plans includes modular furniture arrangements, in which a plurality of differently shaped, freestanding furniture units are positioned in a side-by-side relationship, with upstanding privacy screens attached to at least some of the furniture units to create individual, distinct workstations and/or offices. Both of these types of modular furniture systems, as well as others, have been widely received due to their ability to be readily reconfigured and/or moved to a new site, since they are not part of the permanent leasehold improvement.

Hang-on binder bins have been widely used in office furniture arrangements to provide storage space for books, office supplies and the like. Such binder bins are commonly positioned above worksurfaces to provide for efficient use of the office space, and permit ready access by the user. However, existing binder bins may include relatively complex door opening mechanisms including slides, bearings, pivots, or the like that add to the manufacturing costs and complexity of the unit. Also the mechanism may bind, or otherwise fail, requiring repair to permit proper operation of the binder bin.

SUMMARY OF THE INVENTION

One aspect of the present invention is a storage unit for use in an office environment. The storage unit includes a structural frame having two opposing side panels, at least one laterally extending panel extending between and interconnecting the side panels to define an interior space. The frame includes a perimeter defining an access opening that provides access to the interior space. The storage unit includes a flexible cover having opposing side edges, a front edge, and a rear edge. The flexible cover is attached to the structural frame proximate said rear edge of said flexible cover, and extends freely from the attachment to the frame. The flexible cover has an engagement feature which is selectively engageable with the frame at first and second locations on the frame. Engagement of the cover with the frame at the first location places the flexible cover in a closed position with the opposing side edges of the flexible cover extending proximate the perimeter defining the access opening. Engagement of the flexible cover with the frame at the second location places the flexible cover in an open position wherein the flexible cover is positioned to allow access to the interior space of the storage unit through the access opening.

Another aspect of the present invention is a partition panel system for use in an office environment. The partition panel system includes a partition panel and a storage unit attached to the partition panel. The storage unit has two side panels and a laterally extending panel extending between and interconnecting the side panels. The storage unit defines an interior space and an access opening. The storage unit also includes a flexible cover having opposing side edges, a front edge, and a rear edge. The flexible cover is attached to the storage unit proximate the rear edge of the cover, and extends freely from the attachment to the storage unit. The flexible cover has an engagement feature which is selectively engageable with the storage unit at first and second locations on the storage unit. Engagement of the flexible cover with the storage unit at the first location places the flexible cover in a closed position wherein the cover substantially obstructs access to the interior space of the storage unit. Engagement of the flexible cover with the storage unit at the second location places the flexible cover in an open position wherein the cover is positioned to allow access to the interior space of the storage unit through the access opening.

Another aspect of the present invention is a storage unit for use in office environments. The storage unit includes a structural frame having two opposing side panels, and at least one laterally extending panel extending between and interconnecting the side panels. The structural frame has a perimeter defining an access opening. The storage unit includes a flexible cover having opposing side edges, a front edge, and a rear edge. The flexible cover is attached to the frame proximate the rear edge of the flexible cover, and the flexible cover extends freely from the attachment to the frame. The flexible cover has an engagement portion located proximate the front edge of the flexible cover, and the flexible cover engagement portion is selectively engageable with the frame at first and second locations. The engagement portion is engageable with the frame at the first location in a first attachment method, and the engagement portion is engageable with the frame at a second location in a second attachment method.

Another aspect of the present invention is a storage unit for offices including a housing having a pair of generally upright, horizontally spaced apart end walls, and a generally horizontal shelf extending between and interconnecting the end walls and defining a storage space having an opening to provide access to the storage space. Each end wall defines a generally horizontal edge portion and a generally vertical edge portion with a curved portion extending between the vertical and horizontal portions to define therewith a pair of side edges to the opening. A flexible cover is secured to the housing, and the flexible cover is movable between an open position providing access to the storage space, and a closed position wherein the cover bends to fit closely around the side edges to close off the storage space.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
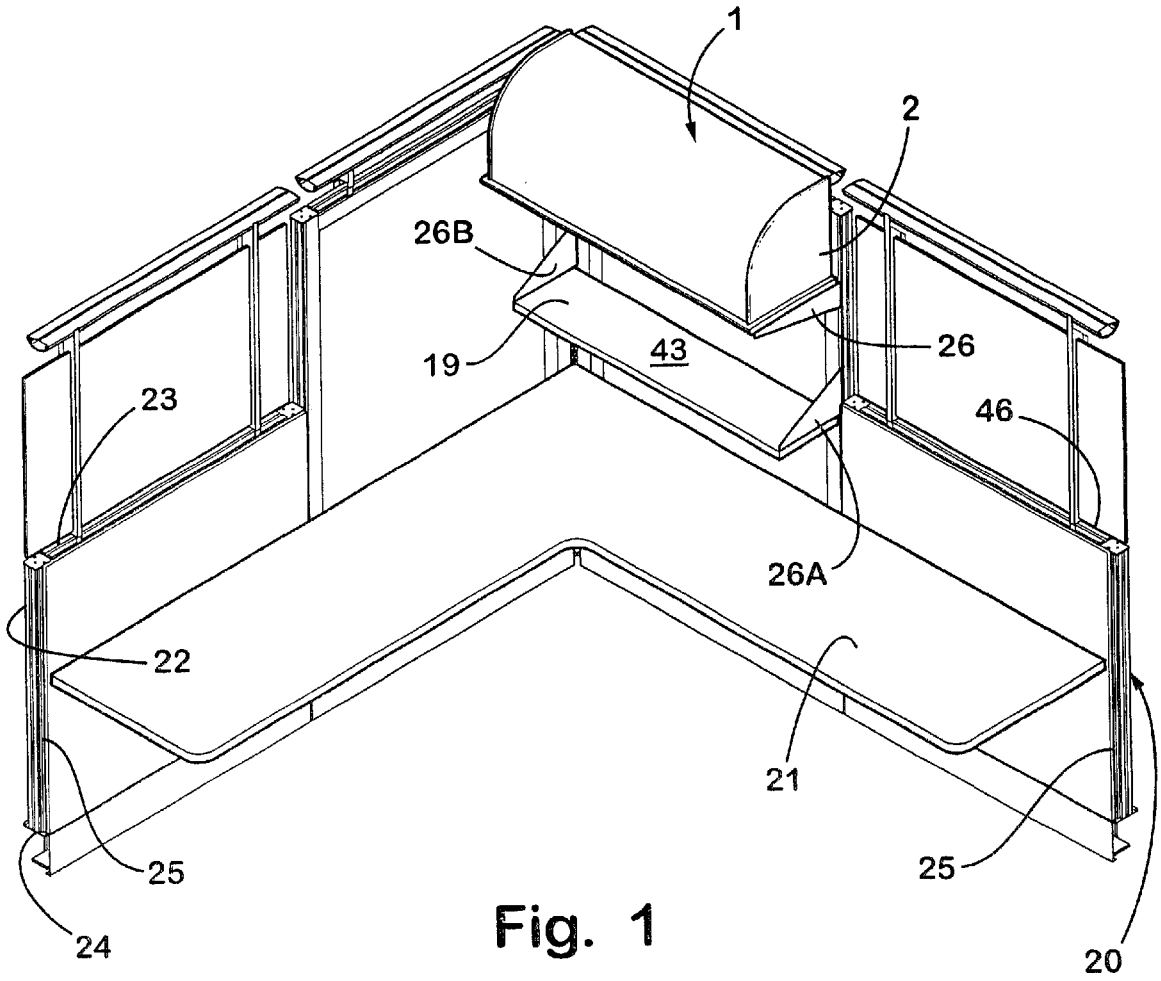
FIG. 1 is a perspective view of a partition including a storage unit having a flexible cover according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a storage unit embodying the present invention, which is particularly designed for use in open office plans, and other similar settings and environments. In the illustrated example, storage unit 1 includes a structural frame 2 including opposing side panels 3 (FIG. 2), and at least one laterally extending panel such as a shelf 4 extending between and interconnecting the side panels 3 to define an interior space 5. The frame 2 includes a perimeter 6 defining an access opening 7 that provides access to the interior space 5. A flexible cover 8 has opposing side edges 9, a front edge 10, and a rear edge 11. The flexible cover 8 is attached to the structural frame 2 proximate the rear edge 11 of the flexible cover 8. The flexible cover 8 extends freely from the attachment to the frame 2, and includes an engagement feature such as the end portions 12 of the front edge 10 that are selectively engageable with the frame at first locations 13 and second locations 14 on frame 2. As described in more detail below, the first locations 13 include a slot 15 that receives the end portions 12 of the flexible cover 8, and the second locations 14 include magnets 16 that engage the metal strip 17 forming the front edge 10 of the flexible cover 8 to retain the flexible cover 8 in the closed position. The flexible cover 8 engages the frame 2 at the first location 13 to place the flexible cover 8 in a closed position (FIG. 1) with the opposing side edges 9 of the flexible cover 8 extending proximate the perimeter 6. Engagement of the flexible cover 8 with the frame 2 at the second location 14 places the flexible cover 8 in an open position (FIG. 2) wherein the flexible cover 8 is positioned to allow access to the interior space 5 of the storage unit 1 through the access opening 7.

Figure 2:
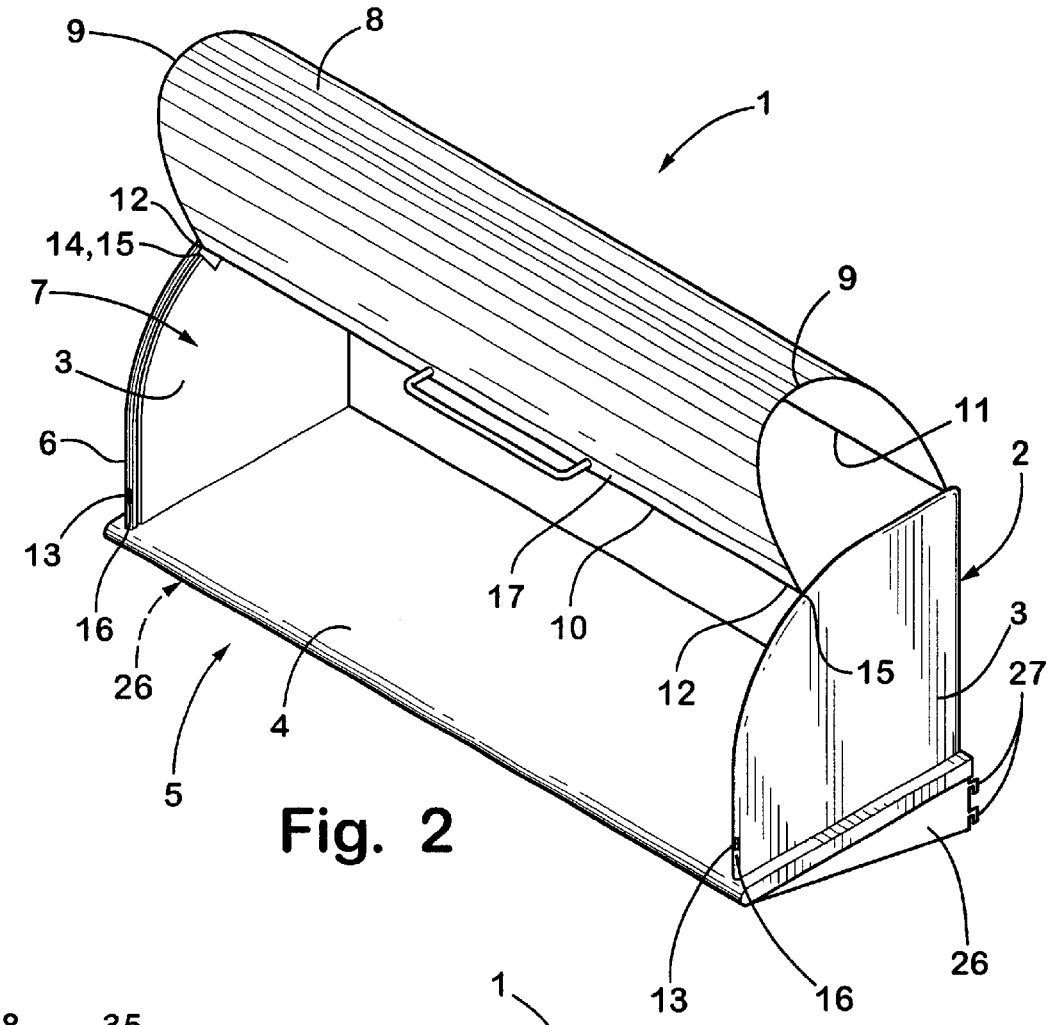
FIG. 2 is a perspective view of the storage unit of FIG. 1 showing the flexible cover in an open position.

As shown in FIG. 1, the storage unit 1 may be mounted to a partition 20 above a worksurface 21 in a generally overhead position relative to a seated user. Partition 20 is described in detail in commonly assigned, co-pending U.S. patent application Ser. No. 09/881,833, filed on even dated herewith, entitled PANEL SYSTEM, the entire contents of which are incorporated herein by reference. Partition 20 includes a plurality of upright frame members 22, and upper and lower horizontal frame members 23 and 24. Each of the upright frame members 22 includes a vertical row of slots 25. With further reference to FIG. 2, a pair of metal brackets 26 are secured to the shelf 4 via screws or the like (not shown). The brackets 26 include hooks 27 that are engageable with the vertical row of slots 25 to support the storage unit 1 on the partition 20.

Figure 3:
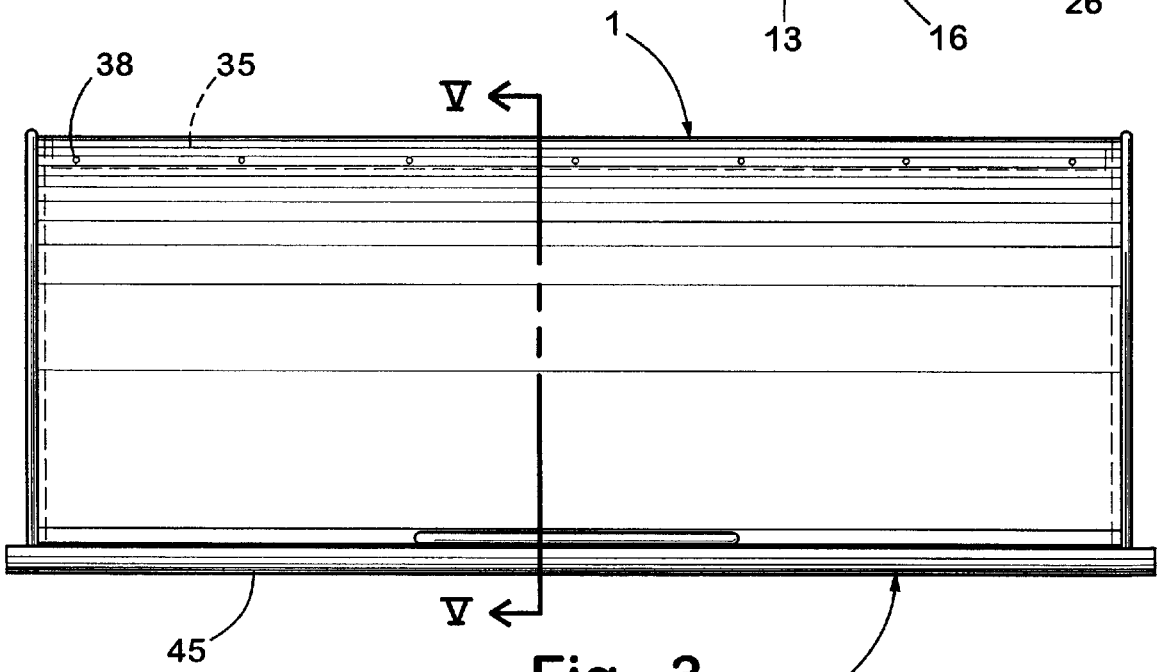
FIG. 3 is a front elevational view of the storage unit of FIG. 1.
Figure 4:
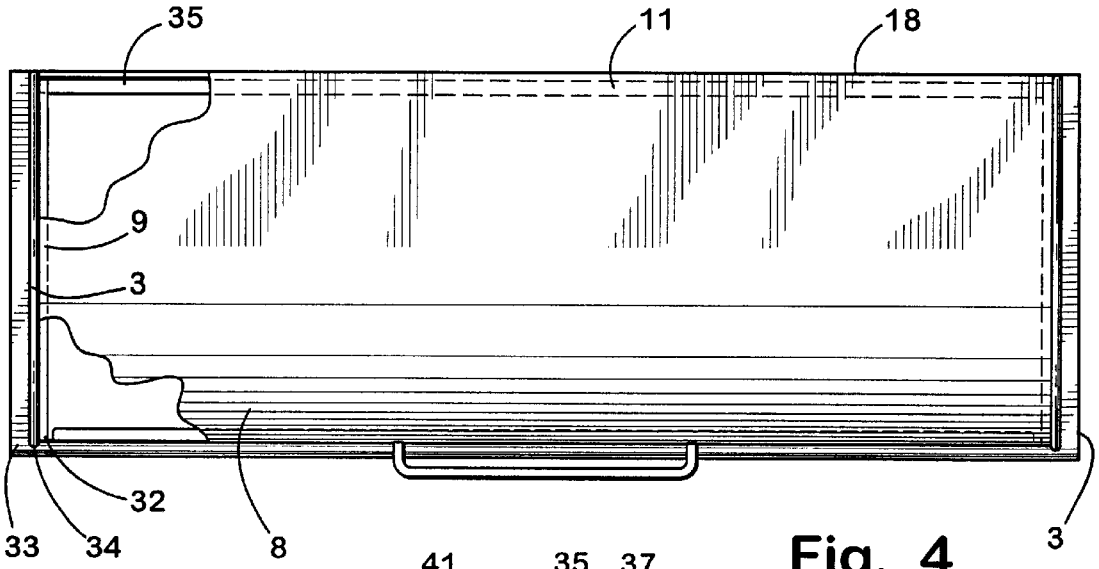
FIG. 4 is a partially fragmentary plan view of the storage unit of FIG. 1.
Figure 5:
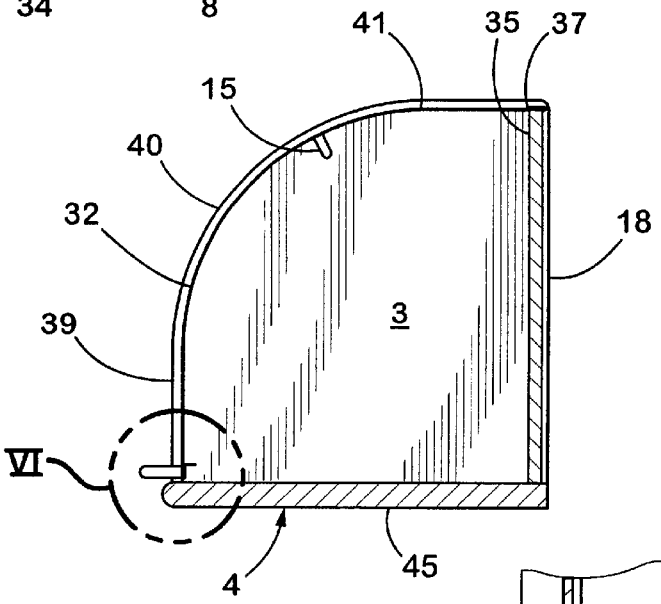
FIG. 5 is a cross-sectional view taken along the line V—V, FIG. 3.
Figure 6:
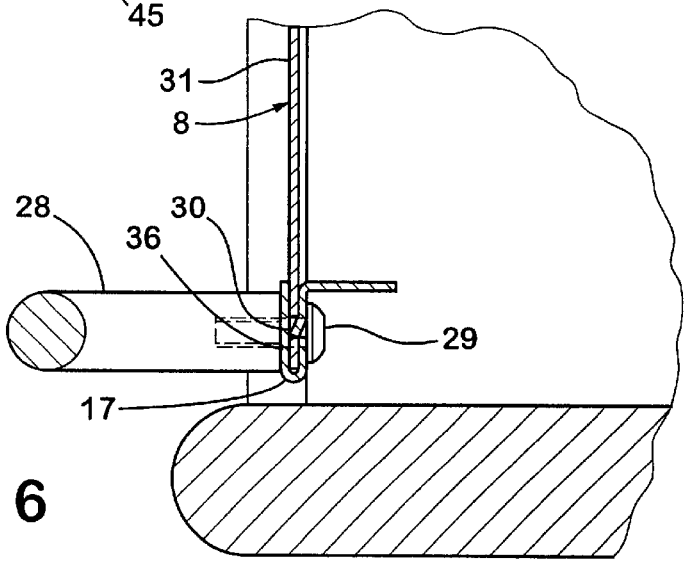
FIG. 6 is a fragmentary, enlarged view of the storage unit of FIG. 5 illustrating the handle of the flexible cover.

With further reference to FIGS. 3 and 4, the side panels 3, shelf 4, and rear panel 18 are all made of a wood material, and are interconnected in a conventional manner. Flexible cover 8 includes thin polymer sheet 31 made of a flexible polymer material that may be opaque, transparent, or colored to provide a pleasing appearance that is compatible with the partition system. Although other materials or thicknesses could be utilized, polymer sheet 31 is a 0.030 inch thick translucent PVC material in a preferred embodiment. A metal trim strip 17 is secured to the forward edge 10 of polymer sheet 31, and a handle 28 is secured to the metal strip 17 via a fastener 29 such as a screw, rivet, or the like. Trim strip 17 includes a plurality of bent-in portions forming "barbs" 30 that engage the polymer sheet 31 to retain the metal strip 17 on the polymer sheet 31. As illustrated in FIG. 4, side panels 3 include an edge portion 32 that is offset inwardly relative to the outer portion 33 of side panels 3, such that the edges 9 of the flexible cover 8 fit closely around the edge 32 when the cover is in a closed position. When the flexible cover 8 is in a closed position, the edges 9 of the polymer sheet 31 are thus positioned below the outer edge portion 34 of side panels 3. A metal strip 35 extends along the rear edge 11 of the flexible cover 8, and includes a U-shaped portion 37 that is substantially similar to U-shaped portion 36 of the front metal strip 17 to receive the edge of the polymer sheet 31. The metal strip 35 is secured to the rear panel 18 via screws 38 (FIG. 3) or the like. Although the rear edge 11 of the flexible cover 8 is thus rigidly connected to the frame 2 of the storage unit 1, the polymer sheet 31 has sufficient flexibility to permit the flexible cover 8 to be moved to the open position illustrated in FIG. 2. Slots 15 extend inwardly from the edge 32, and receive the end portions 12 of the metal strip 17 to retain flexible cover 8 in the open position of FIG. 2. The slots 15 extend inwardly from the inner edge portion 32 only, and not from outer edge portion 34 of the sidewalls 3. Thus, slots 15 are not generally visible from the outside of the storage unit 1 when the flexible cover 8 is in the closed position of FIG. 1. A pair of small magnets 16 are positioned in the lower portion of the edge 32 directly adjacent the shelf 4. The magnets 16 are embedded in the side panels 3, and are generally flush with the edge surface 32 to retain the flexible cover 8 in the closed position of FIG. 1. Magnets 16 may be disklike, rectangular, or other suitable shape and size to retain the flexible cover in the closed position. The edge portion 32 of side panels 3 includes a vertically extending front portion 39 (FIG. 5), and a horizontally extending upper portion 41, with a smooth radiused portion 40 extending between the vertical portion 39 and the horizontal portion 41. The relatively large radius 40 permits the polymer sheet 31 to flex around the edge portion 32 to permit the flexible cover 8 to close with side edges 9 contacting edge 32. Side panels 3, shelf 4, and rear panel 18 are preferably made from medium density powder coated fiber board, wood or other suitable material.

Figure 7:
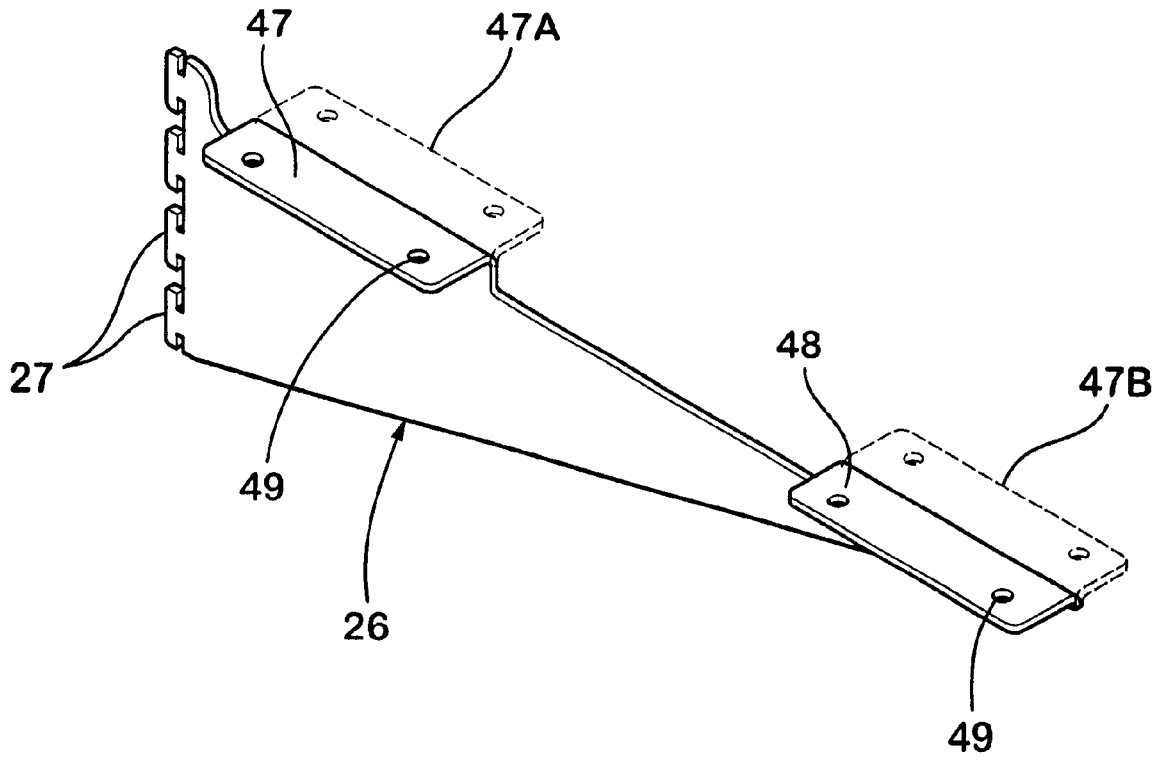
FIG. 7 is a perspective view of the bracket of FIG. 1.

With further reference to FIG. 7, bracket 26 is formed from sheet metal, and includes a plurality of hooks 27 that are received in the vertical row of openings 25 of partition 20. Hooks 27 open both upwardly and downwardly, such that bracket 26 may be secured to the lower surface 45 of shelf 4 of storage unit 1 in the configuration illustrated in FIGS. 1 and 2. Alternately, bracket 26 may be secured to an upper surface 19 of a shelf 43 (FIG. 1), with the bracket 26 extending upwardly above the shelf 43. When the bracket 26 is attached to the lower surface 45 of shelf 4 of storage unit 1, storage unit 1 may be positioned directly adjacent the upper edge 46 of partition 20, such that a substantial portion of rear panel 18 of storage unit 1 extends above the upper edge 46 of partition 20. Positioning of the storage unit 1 in this manner permits use of a somewhat lower partition 20, with storage unit 1 maintaining privacy for the user. Thus, a less expensive, lower partition 20 can be utilized. When bracket 26 is secured to an upper surface 19 of a shelf 43, the area below the shelf is not obstructed, such that file storage units, cabinets, or other items can be positioned directly below the shelf.

The bracket 26 illustrated in FIG. 7 is a "right hand" bracket when utilized to support a storage unit 1 in the configuration illustrated in FIG. 1. Alternately, the bracket 26 of FIG. 7 can be rotated 180° and utilized as a "left hand" bracket 26B with shelf 43 as illustrated in FIG. 1. Bracket 26 includes first and second tabs 47 and 48, each of which have openings 49 therethrough that accept conventional wood screws or other suitable fasteners for attaching the bracket 26 to a storage unit 1 or to a shelf 43. A "left hand" bracket 26 may also be made from the same blank of sheet metal by bending the tabs into the positions shown in dashed lines designated 47A and 47B in FIG. 7. A "left hand" bracket 26 may be utilized in a left hand position when supporting a storage unit 1, or rotated 180° and used in the right hand position designated 26A in FIG. 1 when utilized to support shelf 43. Thus, a "right hand" bracket 26 can be used in a lower right position to support a binder bin 1, or an upper left position when supporting a shelf, and a "left hand" bracket 26 can be used in a lower left hand position to support a storage unit 1, or rotated 180° and utilized as an upper right hand bracket when supporting a shelf.

The storage unit 1 of the present invention has a relatively simple and durable construction that eliminates the complicated and costly slide and/or pivot mechanisms conventionally used for binder bins and the like. The appearance of the storage unit 1 can be readily varied to meet the requirement of a user by selecting a polymer sheet 31 having the desired color and/or light-transmitting properties. The mounting brackets 27 may be configured to readily mount the storage unit 1 on a wide variety of partitions having vertical rows of openings in the partition frame.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A storage unit for use in an office environment, comprising:

a structural frame having opposing side panels, and at least one laterally extending panel extending between and interconnecting said side panels to define an interior space, said frame includes a perimeter defining an access opening providing access to said interior space;

a flexible cover having opposing side edges, a front edge and a rear edge, said flexible cover attached to said structural frame proximate said rear edge of said flexible cover, said flexible cover extending freely from said attachment to said frame; and wherein said flexible cover has an engagement feature which is selectively engageable with said frame at first and second locations on said frame, engagement of said flexible cover with said frame at said first location placing said flexible cover in a closed position with said opposing side edges of said flexible cover extending proximate said perimeter defining said access opening, and engagement of said flexible cover with said frame at said second location placing said flexible cover in an open position wherein said flexible cover is retained in a position that allows access to said interior space of the storage unit through said access opening, and wherein a middle portion of said opposing side edges of said flexible cover are spaced outwardly from said perimeter defining said access opening, and defining a gap between said opposing edges and said perimeter.

2. A storage unit as defined in claim 1, wherein:

said flexible cover is secured in said closed position with a magnetic attachment.

3. A storage unit as defined in claim 2, wherein:

said magnetic attachment includes a metallic strip attached to said flexible cover and at least one magnetic element attached to said frame.

4. A storage unit as defined in claim 1, wherein:

said side edges of said flexible cover define front portions adjacent said front edge, said front edges extending transverse to said perimeter when said flexible cover is in said open position.

5. A storage unit as defined in claim 3, wherein:

said metallic strip is attached along said front edge of said flexible cover and provides a rigid front edge to said cover, and a handle is attached to said metallic strip.

6. A storage unit as defined in claim 1, wherein:

said flexible cover is constructed of a translucent material.

7. A storage unit as defined in claim 1, wherein:

said flexible cover is constructed of a polymeric material.

8. A storage unit as defined in claim 1, wherein:

said frame includes at least one slot for engagement with said cover.

9. A storage unit as defined in claim 8, wherein:

said flexible cover engages said at least one slot when in said open position.

10. A storage unit as deemed in claim 1, wherein:

said flexible cover is located substantially exterior to said access opening in said open and closed positions.

11. A storage unit as defined in claim 1, wherein:

said side panels each include outer edges defining said access opening perimeter and said perimeter has an upper perimeter portion and a front perimeter portion and said flexible cover substantially overlays said outer edges defining said perimeter when said cover is in said closed position.

12. A storage unit as defined in claim 11, wherein:

said outer edges include an arcuate transition between said upper and front perimeter portions.

13. A storage unit as defined in claim 11, wherein:

said outer edges each define an approximately 90° angle transition between said upper and front perimeter portions.

14. A storage unit as defined in claim 1, wherein:

said flexible cover is constructed of a flexible material having a substantially uniform thickness and free of discrete hinge elements.

15. A storage unit as defined in claim 1, wherein:

said cover includes a rigid portion proximate said front edge and extending between said side edges.

16. A partition panel system for use in an office environment, comprising:

a partition panel;

a storage unit attached to said partition panel, said storage unit having two side panels and a laterally extending panel extending between and interconnecting said side panels, said storage unit defining an interior space and an access opening;

a flexible cover having opposing side edges, a front edge, and a rear edge, said flexible cover attached to said storage unit proximate said rear edge of said cover in a manner that prevents said rear edge from sliding relative to said side panels; and wherein said flexible cover has an engagement feature which is selectively engageable with said storage unit at first and second locations on said storage unit, engagement of said flexible cover with said storage unit at said first location placing said flexible cover in a closed position wherein said cover substantially obstructs access to said interior space of said storage unit, and engagement of said flexible cover with said storage unit at said second location placing said flexible cover in an open position wherein said cover is positioned to allow access to said interior space of the storage unit through said access opening.

17. A partition panel system as defined in claim 16, wherein:

said flexible cover is secured in said second location with a magnetic attachment.

18. A partition panel system as defined in claim 16, wherein:

said side edges of said flexible cover are U-shaped when in said open position with end portions of said side edges connected to said storage unit proximate said side panels, and a central portion of said side edges spaced apart from said side panels to form a gap.

19. A partition panel system as defined in claim 16, wherein:

said storage unit includes at least one slot for engagement with said cover.

20. A partition panel system as defined in claim 19, wherein:

said flexible cover engages said at least one slot when said flexible cover is in said first location.

21. A partition panel system as defined in claim 16, wherein:

said flexible cover is constructed of a translucent material.

22. A partition panel system as defined in claim 16, wherein:

said flexible cover is constructed of a polymeric material.

23. A partition panel system as defined in claim 16, wherein:

said flexible cover includes a handle.

24. A partition panel system as defined in claim 18, wherein:

said metallic strip is attached along said front edge of said flexible cover and provides a rigid front edge to said cover, and a handle is attached to said metallic strip.

25. A partition panel system as defined in claim 16, wherein:

said side panels each include outer edges defining said access opening perimeter and said perimeter has an upper perimeter portion and a front perimeter portion and said flexible cover substantially overlays said outer edges defining said perimeter when said cover is in said closed position.

26. A partition panel system as defined in claim 16, wherein:

said flexible cover is located substantially exterior to said opening in said open and closed positions.

27. A partition panel system as defined in claim 16, wherein:

said flexible cover is constructed of a flexible material having a substantially uniform thickness and free of discrete hinge elements.

28. A partition panel system as defined in claim 16, wherein:

said cover includes a rigid portion proximate said front edge and extending between said side edges.

29. A partition panel system as defined in claim 25, wherein:

said outer edges include an arcuate transition between said upper and front perimeter portions.

30. A partition panel system as defined in claim 25, wherein:

said outer edges each define an approximately 90° angle transition between said upper and front perimeter portions.

31. A storage unit for use in an office environment, comprising:

a structural frame having two opposing side panels, and at least one laterally extending panel extending between and interconnecting said side panels, said structural frame having a perimeter defining an access opening;

a flexible cover having opposing side edges, a front edge portion, and a rear edge, said flexible cover attached to said frame proximate said rear edge of said flexible cover, said flexible cover extending freely from said attachment to said frame such that movement of said front edge is not constrained by said side panels of said structural frame; and wherein said flexible cover has an engagement portion located proximate the front edge portion of said flexible cover, and said flexible cover engagement portion is selectively engageable with said frame at first and second locations, wherein said engagement portion engages said frame at said first location to define a closed position in a first attachment method and said engagement portion engages said frame at said second location and retains said flexible cover in an open position in a second attachment method.

32. A storage unit as defined in claim 31, wherein:

said frame further comprises a slot extending transverse to said perimeter at said first location, wherein said first attachment method comprises positioning said engagement portion in said slot with said front edge portion extending transverse to said perimeter, and wherein and said second attachment method comprises a magnetic attachment.

33. A storage unit as defined in claim 31, wherein:

said cover includes a rigid portion proximate said front edge and extending between said side edges.

34. A storage unit as defined in claim 32, wherein:

said magnetic attachment includes a metallic strip attached to said flexible cover and at least one magnetic element attached to said frame.

35. A storage unit as defined in claim 34, wherein:

said metallic strip is attached along said front edge of said flexible cover and provides a rigid front edge to said cover, and a handle is attached to said metal strip.

36. A storage unit as defined in claim 31, wherein:

said flexible cover is located substantially exterior to said access opening when said cover is engaged with said frame at said first and second locations.

37. A storage unit as defined in claim 31, wherein:

said side panels each include outer edges defining said access opening perimeter and said perimeter has an upper perimeter portion and a front perimeter portion and said flexible cover substantially overlays said outer edges defining said perimeter when said cover is in said closed position.

38. A storage unit for offices, comprising:

a housing having a pair of generally upright, horizontally spaced apart end walls, and a generally horizontal shelf extending between and interconnecting said end walls and defining a storage space having an opening to provide access to said storage space, each end wall defining a generally horizontal edge portion and a generally vertical edge portion with a gently curved portion extending between said generally vertical and horizontal portions to define therewith a pair of side edges to said opening; and a flexible cover secured to said housing, said flexible cover movable between an open position providing access to said storage space, and a closed position wherein said cover fits closely around said side edges to close off said storage space, said flexible cover having a front edge portion that extends transverse to said side edges when in said open position.

39. A storage unit as defined in claim 38, including:

a hook adapted to support said storage unit on a partition panel.

40. A storage unit as defined in claim 38, including:

a rigid strip connected to said flexible cover and extending along said front edge portion.

41. A storage unit as defined in claim 38, wherein:

each end wall includes a first connector adjacent said horizontal edge portion adapted to retain said flexible cover in said open position, and a second connector adapted to retain said flexible cover in said closed position.

* * * * *

UNITED STATES PATENT AND TRADEMARK OFFICE

CERTIFICATE OF CORRECTION

PATENT NO. : 6,591,555 B2
DATED : July 15, 2003
INVENTOR(S) : Jonathan J. King et al.

It is certified that error appears in the above-identified patent and that said Letters Patent is hereby corrected as shown below:

Column 6,
Line 40, "deemed" should be -- defined --.

Signed and Sealed this

Twenty-fifth Day of November, 2003

JAMES E. ROGAN
*Director of the United States Patent and Trademark Office*